US007299956B2

(12) United States Patent
Haglund et al.

(10) Patent No.: US 7,299,956 B2
(45) Date of Patent: Nov. 27, 2007

(54) CLOSURE

(75) Inventors: Sylvia Maria Haglund, Oxford (GB); Christopher Paul Ramsey, Wantage (GB); Bernard Gugleilmini, Crimolois (FR)

(73) Assignee: Obrist Closures Switzerland GmbH (CH)

( * ) Notice: Subject to any disclaimer, the term of this patent is extended or adjusted under 35 U.S.C. 154(b) by 333 days.

(21) Appl. No.: 10/473,422

(22) PCT Filed: Mar. 5, 2002

(86) PCT No.: PCT/EP02/02444

§ 371 (c)(1),
(2), (4) Date: Mar. 16, 2004

(87) PCT Pub. No.: WO02/081357

PCT Pub. Date: Oct. 19, 2002

(65) Prior Publication Data

US 2004/0144810 A1 Jul. 29, 2004

(30) Foreign Application Priority Data

Apr. 6, 2001 (EP) ..... 01303262

(51) Int. Cl.
*B67D 3/00* (2006.01)

(52) U.S. Cl. ..... 222/518; 141/364

(58) Field of Classification Search ..... 222/518, 222/511, 512, 513, 514; 141/351–354, 364; 215/339, 338, 364, 840, 352, 273, 289, 303; 220/229

See application file for complete search history.

(56) References Cited

U.S. PATENT DOCUMENTS 4,874,023 A 10/1989 Ulm
4,903,742 A 2/1990 Gagnon
4,991,635 A 2/1991 Ulm
5,046,645 A * 9/1991 Hagan et al. ..... 222/394
5,154,212 A * 10/1992 Weber ..... 141/353
5,431,205 A 7/1995 Gebhard
5,779,086 A * 7/1998 Barrash ..... 220/240
6,123,122 A 9/2000 Dushman
6,131,774 A * 10/2000 Thomas et al. ..... 222/181.2
6,299,037 B1 * 10/2001 Lee ..... 222/518

FOREIGN PATENT DOCUMENTS

EP 0 736 454 A1 9/1996

* cited by examiner

*Primary Examiner*—Lien M. Ngo
(74) *Attorney, Agent, or Firm*—Nixon Peabody LLP; Corinne R. Gorski

(57) ABSTRACT

A closure (10) is provided for a water bottle of the type used in conjunction with a water fountain. The closure (10) comprises a body (20) having an open feed cylinder (50) and a sealing cap (30) which is movable between a sealing position and an open position and is adapted to seal the feed cylinder when in a sealing position. The sealing cap is biased towards a sealing position by biasing means which preferably comprise a plastics spring (70) that anchors the sealing cap (30) to the body (20). The form of the spring (70) and the arrangement of the sealing cap (30) and the feed cylinder (50) are such as to minimize and compensate for creep in the plastics material of the spring (70) in use of the closure (10) to ensure resealing of the feed cylinder (50) if and when the water bottle is removed from the water fountain.

15 Claims, 6 Drawing Sheets

CLOSURE

BACKGROUND OF THE INVENTION

The present invention relates generally to a closure and particularly to a closure for a water bottle of the type used in conjunction with a water fountain. The neck of this type of bottle is closed by the closure to seal it and so that it can be turned upside down before being lowered onto a water fountain spike. The closure must in some way allow entry of the water fountain spike into the interior of the bottle to allow the removal of water.

It is known to provide a closure with a central feed cylinder which is blocked by a sealing cap. As the bottle is lowered onto the water fountain spike the spike pushes the sealing cap out of the feed cylinder. The sealing cap is formed so that it can attach to the water fountain spike as it is pushed out of the feed cylinder. However, it has been found that the sealing cap does not always attach itself to the spike and very often floats up to the top of the bottle. This is particularly common if the spike is not inserted straight into the closure but rather at a slight angle. Precise positioning of the bottle on the spike is not an easy operation, particularly due to the weight and bulk of the bottle.

Whilst in general once the water bottle has been placed on the water fountain it should not need to be removed before the bottle has been fully emptied, there may be circumstances in which removal of the bottle is required. In the prior art system discussed above the sealing cap does not reseal the feed cylinder as the water bottle is removed from the water fountain spike so that water can escape freely from the feed cylinder as the water bottle is removed.

SUMMARY OF THE INVENTION

According to the present invention there is provided a water closure for a water bottle of the type used in conjunction with a water fountain, comprising a body having an open feed cylinder, and a sealing cap movable between a sealing position and an open position and adapted to seal the feed cylinder when in a sealing position, in which the sealing cap is biased towards a sealing position by biasing means.

In a preferred embodiment the sealing cap is anchored to the body by the biasing means, and is movable between a lower sealing position and a raised open position, whereby to allow water to flow through the feed cylinder when the water bottle is placed on a water fountain spike or the like and to reseal the feed cylinder when the water bottle is removed.

It can be seen that a closure with a sealing cap that is anchored to the body has the advantage that the cap cannot float off the body into the water bottle and, due to the biasing means, when the bottle is lifted off the water fountain spike the sealing cap will automatically reseal the feed cylinder. This feature has the additional benefits of preventing refilling of the water bottle and preventing contamination if the water bottle is removed from the water fountain spike for any length of time, for example, if repairs are required to the water fountain.

The biasing means may comprise a spring such as a tension or torsion spring. Other forms of biasing means such as a linearly extending elastic element are not beyond the scope of the invention.

The closure body will generally be formed from a plastics material. The form of any biasing means is of particular importance and it is necessary to consider any effect the choice of material may have on the contents of the water bottle. For example, it is well known that if metals, such as stainless steel, come into contact with water that the taste of the water may be adversely affected. The use of a metal spring, whilst not impossible, is seen as unsatisfactory.

The use of a plastics spring such as a coil spring is preferred but brings with it specific problems which the present invention also seeks to overcome. One of the major considerations when using a plastics spring is the relationship between the spring coefficient and the characteristic known as creep. The higher the spring coefficient the greater the tendency for the plastics material to creep which will reduce the ability of the spring to return. In addition, it is known that chlorine, often present in bottled water, also affects the creep characteristics of plastics.

The spring preferably serves to return the sealing cap even when there is very little or no water left in the bottle. The present invention has been designed to work even if the bottle is not inverted so that the spring is strong enough to return the sealing cap with no additional help in the form of pressure of the water above it.

The present invention accepts that some creep is inevitable given the requirement for it to return the cap even if the bottle is not inverted, and addresses this by optimising the design of the spring and compensating for creep.

The section of the spring material is preferably as close to a circle as possible to minimize creep, whilst allowing for easy moulding. It has been found that material with a substantially square cross section is useful for minimising creep of such a spring whilst being easy to mould.

In addition, the spring may be formed in a substantially unstressed state, to be stressed only when the water fountain bottle is in use, this avoids the possibility that the spring will creep during extended periods of storage before use. However, alternatively the spring may be pre-stressed to some extent to improve its ability to return following stretching. The preferred level of pre-stressing may be a compromise between improving the ability of the spring to return and the level of creep suffered as a result.

Other useful features for a spring include a small cross-sectional area and increased length, both of which reduce stress and therefore creep.

The form of the spring is not of particular importance to the present invention although the use of a coil spring having a conical shape has been found to be particularly advantageous. A conical spring is particularly stable when it is extended, does not twist as it is stretched and does not reduce in diameter as it is stretched. In addition it has been found that this configuration is easy to mould. The use of the conical spring is therefore seen as preferable over, for example, a cylindrical spring.

Whilst the sealing cap of the present invention may of course take the form of an inner or outer cap, i.e. its relationship with the open feed cylinder is as a cover or a plug, in a preferred embodiment the sealing cap takes the form of a stopper element adapted to plug the feed cylinder. In the preferred embodiment the inner sealing cap and feed cylinder are arranged such that the distance the cap is moved by the water fountain spike is greater than the distance the cap must be returned by the spring to reseal the feed cylinder. In other words, at least part of the sealing cap in its lower sealing position must be within the feed cylinder. This may be achieved for example by using an elongate sealing cap. As the water bottle is lowered onto the water fountain spike the spike engages the sealing cap and pushes it through the feed cylinder a distance before the sealing cap emerges from the end of the feed cylinder whereby to unblock it. Over the period of time the sealing cap is raised out of the feed cylinder to allow escape of the contents of the water bottle the plastics material of the spring will inevitably creep to a certain extent. It can be seen, however, that if the water fountain spike is subsequently withdrawn, the distance the sealing cap must be returned by the spring before it blocks the feed cylinder is less than the distance it was originally moved by the water fountain spike.

In a typical closure the displacement is approximately twice the distance required for resealing. In a specific embodiment the closure is arranged so that the bottom of the sealing cap is pushed up through and out of the feed cylinder approximately 25 mm against the action of the biasing means as the bottle is placed on the water cylinder spike, and in its uppermost open position the bottom of the sealing cap is held approximately 15 mm from the feed cylinder opening, such that a return of 10 mm or more provided by the biasing means is sufficient to reseal the feed cylinder.

It is noted by the inventors that there is no particular need for the closure to be removed from the bottle by the end user. Refilling of the container by the user may be unwanted and the manufacturer may wish to prevent this. In addition, because the sealing cap is anchored to the closure body and cannot float into the bottle, there will be no tendency for a user to try to remove the closure in order to access a cap which has floated into the bottle. The closure of the present invention may therefore be permanently secured to the bottle. In this context the term "permanently" means that it is not removable by hand or by a non-specific tool and for example may only be removable using a specific machine. For this purpose the securing means may comprise a hinged annulus which is adapted to be upturned to engage a bead or the like on the bottle.

The present invention will now be more particularly described, by way of example, with reference to the accompanying drawings, in which:

DETAILED DESCRIPTION OF THE PREFERRED EMBODIMENTS

Figure 1:
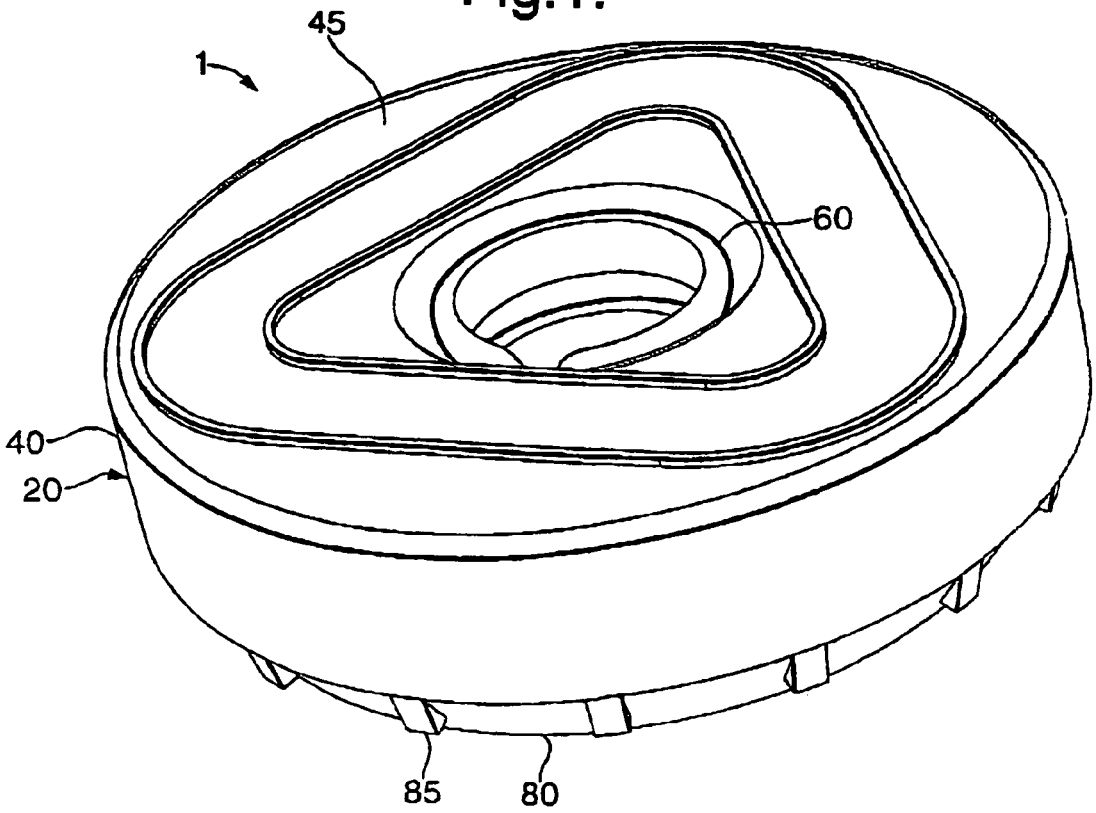
FIG. 1 is a perspective view of a water bottle closure according to the present invention.
Figure 2:
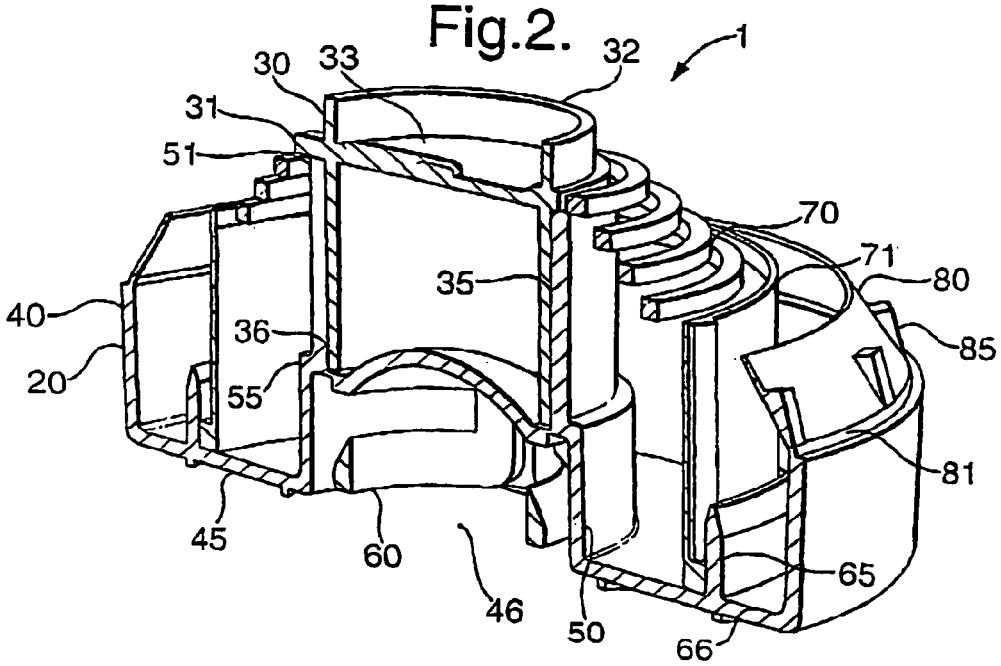
FIG. 2 shows a perspective view of an axial section taken through the closure of FIG. 1 when inverted.

Referring first to FIGS. 1 and 2 there is shown a closure generally indicated 1 which is intended to be connected to a water bottle of the type used in conjunction with a water fountain. The closure 1 comprises a body 20 and a cylindrical sealing cap 30.

The body 20 comprises an annular skirt 40 which is partially closed at one end by an annular top panel 45. A feed cylinder 50 depends from the central opening 46 defined by the annular top panel 45. The feed cylinder 50 narrows slightly at a shoulder 55 and a ring pull element 60 is attached to the interior of the cylinder 50 at the shoulder 55. The ring pull element 60 is frangibly attached to the shoulder 55 and serves to seal the closure 1 before first use.

Radially inwardly of the annular skirt 40 an upstanding wall 65 depends from the annular top panel 45. Together the annular skirt 40 and the upstanding wall 65 define a channel 66.

The sealing cap 30 is slidably mounted in the feed cylinder 50. The main body 35 of the sealing cap 30 extends from the shoulder 55 of the feed cylinder 50 to the end 51 of the feed cylinder 50 at which point a circumferential abutment band 31 projects radially outwardly from the sealing cap cylinder 30. The sealing cap 30 is closed by a panel 33 at its lower end level with the circumferential abutment band 31. It can be seen that the sealing cap 30 is a stopper element which is adapted to plug the feed cylinder 50.

The exterior dimensions of the sealing cap 30 are approximately equal to the interior dimensions of the feed cylinder 50 to allow relative sliding movement but sealed at all relative positions. The circumferential abutment band 31 defines a first end position of the sealing cap 30. An upstanding collar portion 32 extends away from the circumferential abutment band 31. The circumferential abutment band 31 also serves as a point of connection for one end of a substantially conical spring 70.

In practice the conical spring 70 may be injection moulded in-line and opposite corners of the square spring section will line up along a diagonal line along which the mould breaks open. The resulting spring is inclined at approximately 45°, as shown in the drawing. In order to fit within the dimensions of the cap the vertical distance from the circumferential abutment band 31 to the annular top panel 45, to which the spring 70 must be secured, must be bridged because such a spring does not extend the full distance in this unstressed, as-formed state. A spring 70 having a rectangular cross section could bridge the vertical distance; however, this has been shown to result in increased creep of the plastics material and it is therefore preferred to use a spring with a square cross-section. Accordingly the other end of the spring 70 is attached to a tubular bridging portion 71 which bridges the gap between the lower end of the spring and the annular top panel 45. The spring 70 is secured to the annular top panel 45 by virtue of an interference fit of the bridging portion 71 within the upstanding wall 65.

Figure 4:
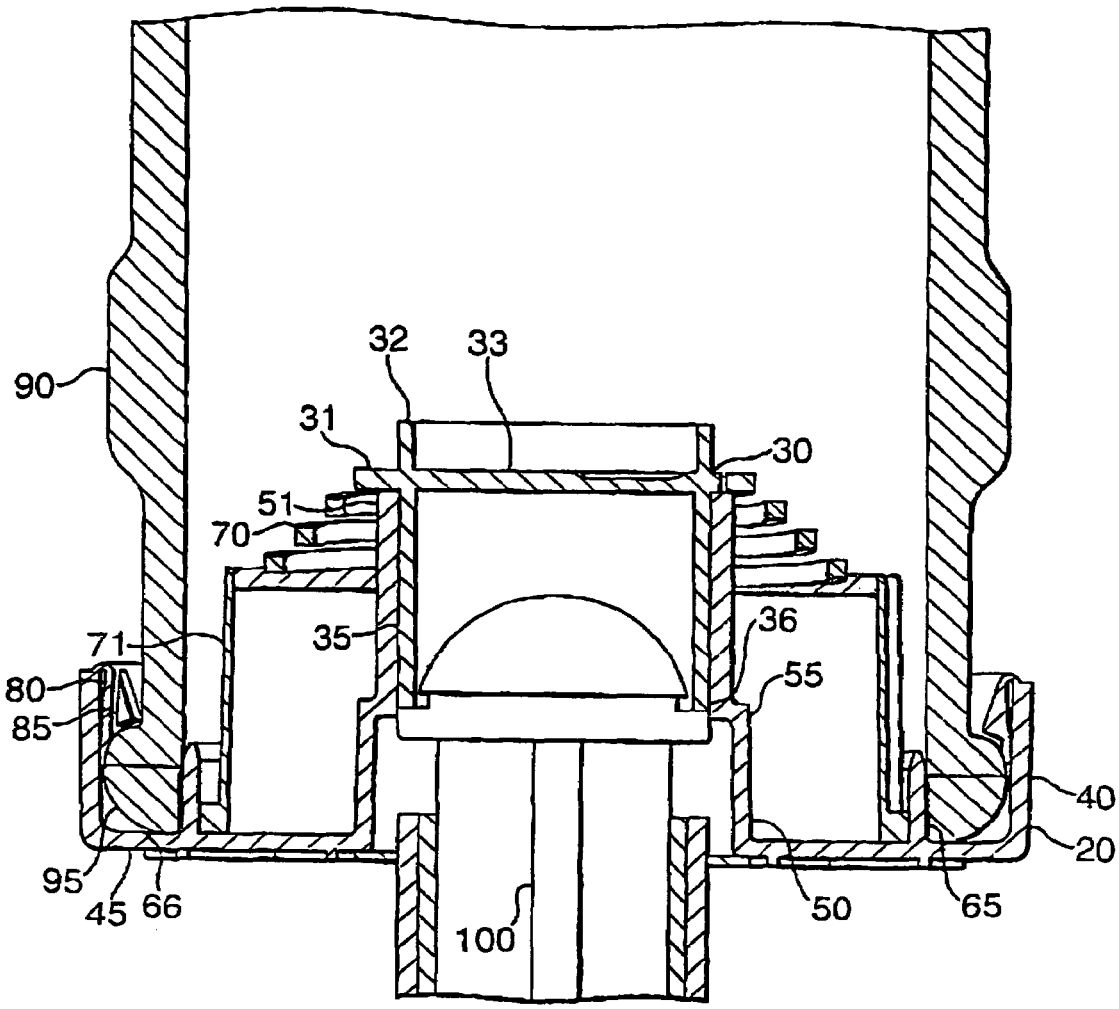
FIG. 4 shows the closure of FIG. 3 as it is first positioned over a water fountain spike.
Figure 5:
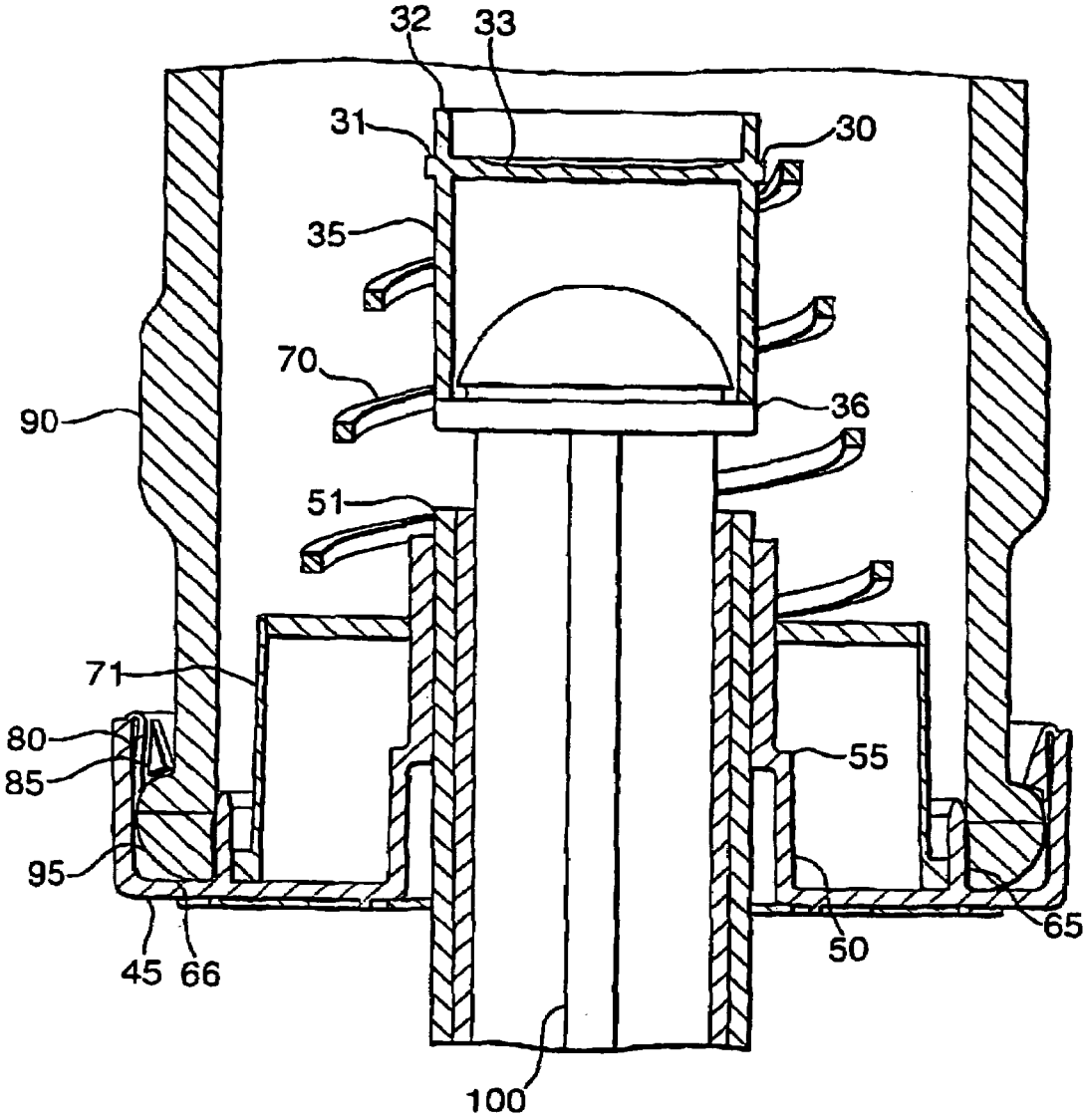
FIG. 5 shows the closure of FIG. 4 in which the water bottle has been fully lowered onto the water fountain spike so that the closure feed cylinder is open.

An annular flap 80 is hingedly connected to the free end of the annular skirt 40 by a film hinge 81. The annular flap 80 has a plurality of circumferentially spaced wedge-shape elements 85 which, when the closure 1 is secured to a bottle and the annular flap is upwardly turned, are adapted to engage a rim of the bottle neck so as to secure the closure to the bottle as is shown in FIGS. 3 to 5.

The working of the closure will now be described in relation FIGS. 3 to 5.

Figure 3:
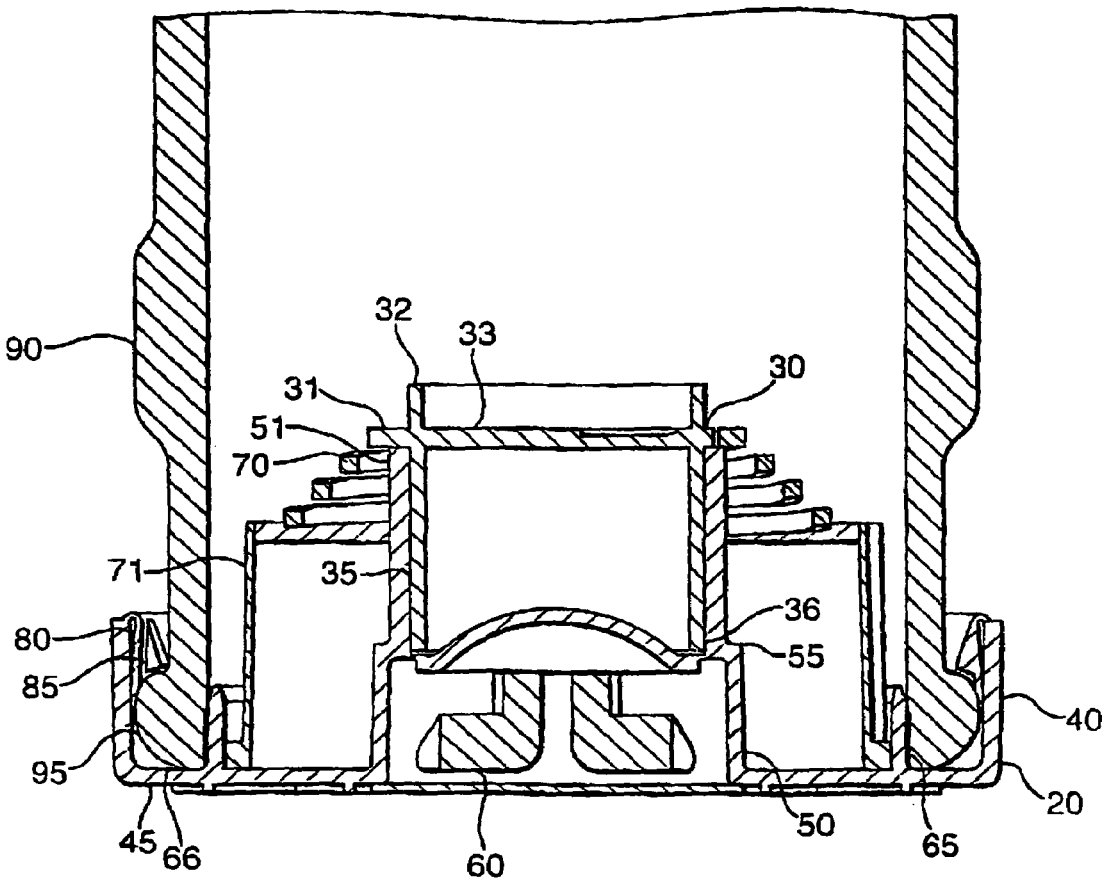
FIG. 3 is an axial section of the closure shown secured to a water bottle.

FIG. 3 shows the closure 1 secured to the neck 90 of a water bottle, typically a 5 gallon bottle. The bottle neck 90 is received in the channel 66 formed between the upstanding wall 65 and the annular skirt 40. The width of the channel 66 is such that the bottle neck 90 is slightly wider. As a result, when the closure is applied the wall 65 is forced inwards. The bridging portion 71 is therefore held more tightly in place.

The annular flap 80 is turned upwardly so that the wedge elements 85 engage a bead rim 95. It will be appreciated that because the flap 80 is folded flat against the skirt 40 and because of the now inwardly directed elements 85, it is extremely difficult to lever the flap 80 back to its starting position.

The ring pull element 60 is shown still attached and it can be seen that the sealing cap 30 cannot therefore be pushed upwardly in this state. In this inoperative position the spring 70 is substantially unstressed.

Referring now to FIG. 4 the ring pull element 60 has been removed and the opening 46 of the annular top panel 45 has been aligned with a water fountain spike 100. The dimensions of the feed cylinder 50 below the shoulder 55 are such that the spike 100 can slide freely through it. The widest point of the spike 100 is of substantially the same circumferential dimensions as the interior of the feed cylinder 50 so that it contacts the lower end 36 of the sealing cap 30 as shown in the drawing.

Referring now to FIG. 5 it can be seen that as the water bottle 90 is lowered on to the water fountain spike 100 the spike 100 pushes the sealing cap 30 through the feed cylinder 50 against the biasing action of the spring 70. FIG. 5 shows the spike 100 fully inserted and it can be seen that in this second end position the sealing cap 30 no longer plugs the feed cylinder 50 so that water can escape from the bottle.

The spring 70 is now in a stressed condition and over a period of time will inevitably creep, consequently its ability to return the sealing cap 30 will be diminished.

Because the sealing cap 30 is formed as a stopper it will seal the feed cylinder 50 as soon as the end 36 of the main body 35 is withdrawn into the feed cylinder 50. The sealing effect of the sealing cap 30 is not therefore dependent on a complete withdrawal back to the point at which the circumferential abutment band 31 prevents further movement. It can be seen therefore that the distance the end 36 of the main body 35 is moved by the spike 100 is much greater than the distance it is from the end 51 of the feed cylinder 50 when the water fountain spike 100 is fully inserted. Therefore the distance the spring 70 must return the sealing cap 30 in order for it to seal the feed cylinder 50 is much less than the distance it was initially moved. This design thereby compensates for creep of the plastics material when the closure 10 is in use.

Figure 6:
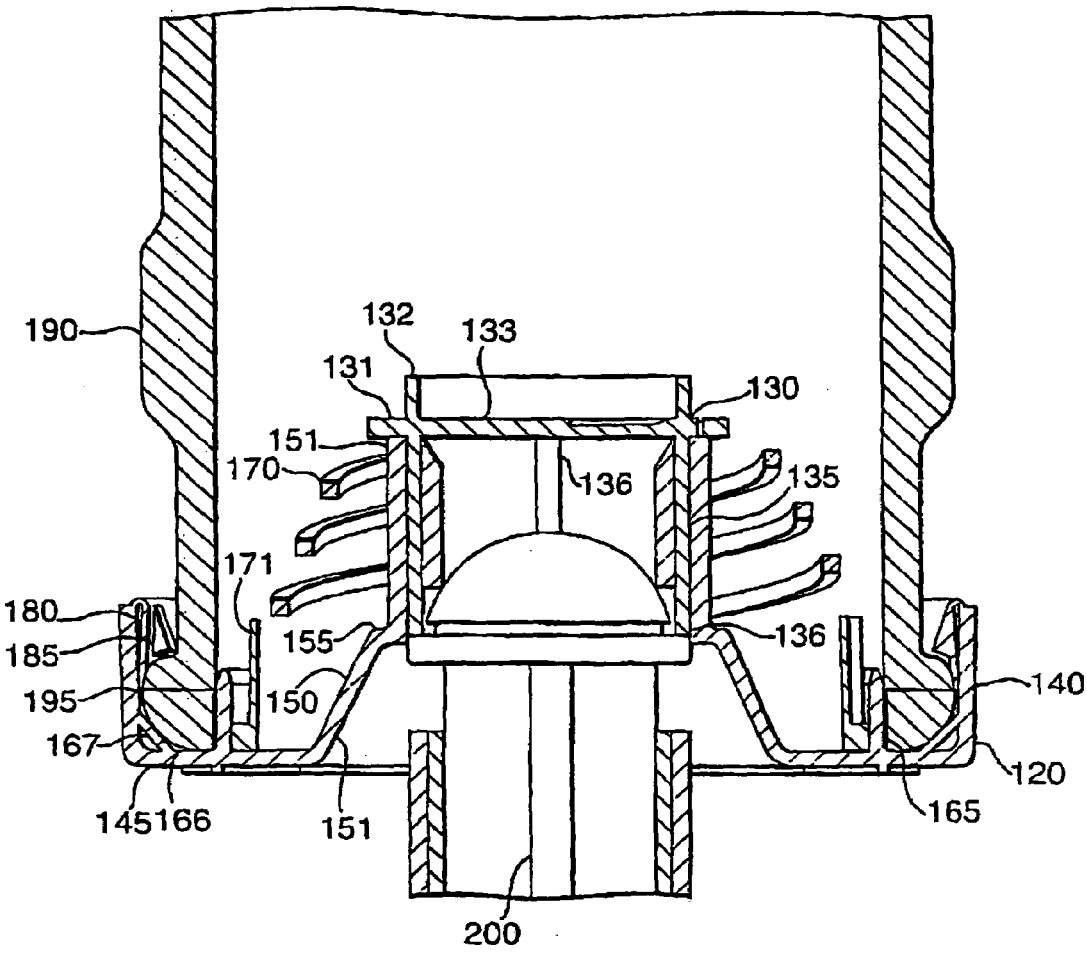
FIG. 6 is an axial section through a closure formed according to an alternative embodiment shown secured to a water bottle.

FIG. 6 is an axial section through a closure 101 formed according to an alternative embodiment. The closure 101 is shown attached to a bottle neck 190 in the same position as FIG. 4 in which the bottle has been positioned over a water fountain spike 200. Like reference numerals refer to like parts.

In this embodiment the conical spring 170 is exactly the same. However, the length of the bridging portion 171 is decreased. This means therefore that in order to bridge the distance between the circumferential abutment band 131 to the annular top panel 145 the spring 170 must be stretched to allow the bridging portion 171 to be pressed within the upstanding wall 165. The spring 171 is therefore quite significantly pre-stressed. Although this adversely affects the level of creep, when the spring 171 is further extended during use the force provided by the spring to return the cap 130 is increased.

In this embodiment the inner surface of the main body 135 of the sealing cap 130 has a plurality of axial ribs 136 which project inwardly and are positioned so that they are contacted by the domed head portion 101 of the spike 200. This means that there is additional contact between the spike 200 and the sealing cap 130. This alternative embodiment also has an additional tamper-prevention feature. As discussed with respect to FIG. 3, the annular flap 180 is turned upwardly and wedge elements 185 engage a bead rim 195. This helps prevent removal of the closure from the bottle neck. To help prevent the possibility of placing a tool between the annular skirt 140 and the bottle neck 190 and attempting to lever the two apart to try to flip the flap 180 back down, the annular skirt 140 is joined to the channel 166 by a strengthening strut 167.

As previously discussed, precise positioning of a water bottle over a water fountain spike is a difficult operation. The shoulder 55 of the feed cylinder 50 of FIG. 4 is joined to the annular top panel 45 by a straight cylindrical sleeve 51. In this alternative embodiment the sleeve 51 is conical. This conical sleeve 51 acts as a guide surface for the incoming spike 200 so that precise positioning is not required. If the bottle is mis-positioned it can still be lowered onto the spike 200 because the spike can slide up the guiding surfaces of the sleeve 51.

Figure 7:
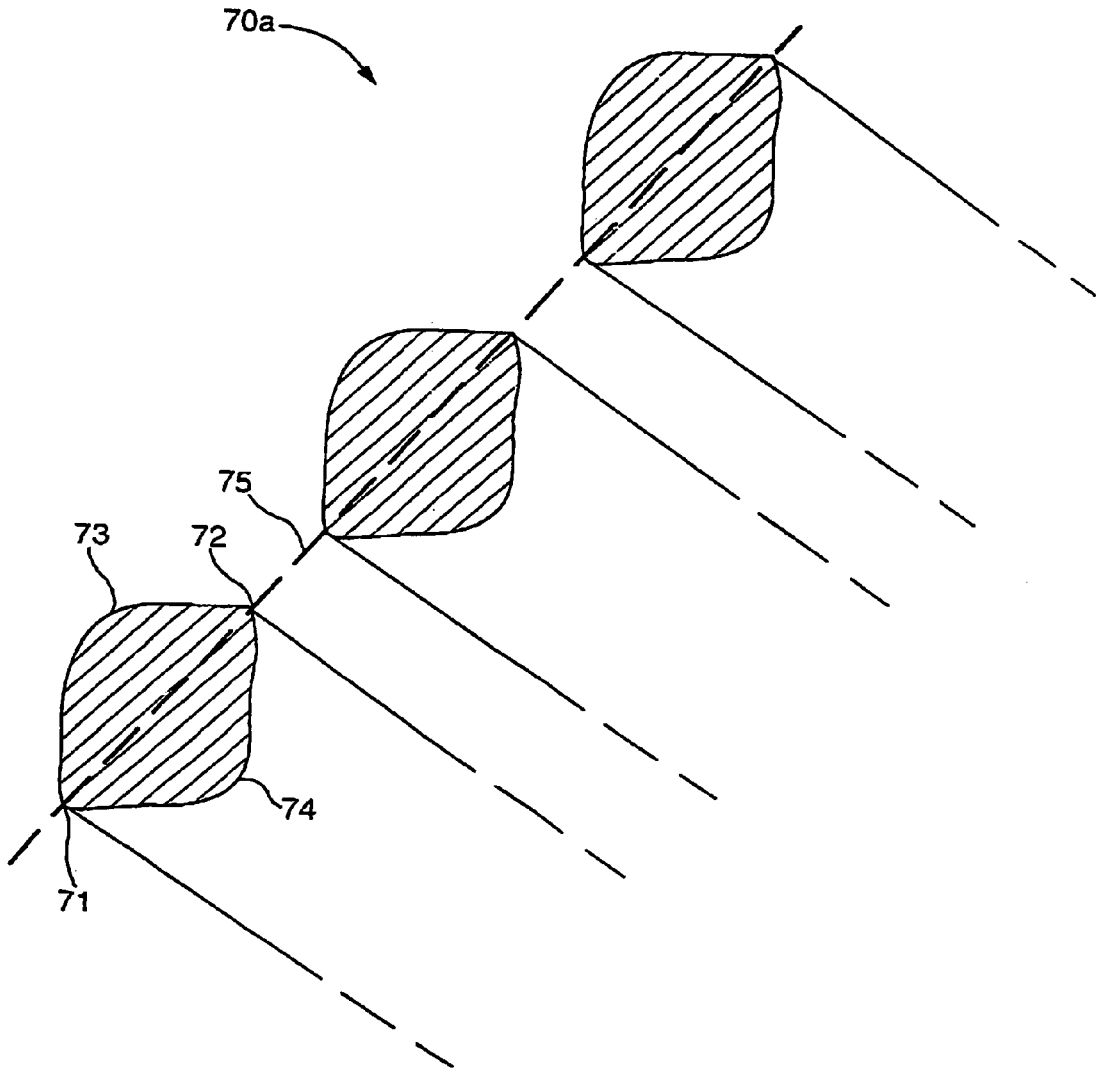
FIG. 7 is a cross-section through part of a conical coil spring formed as part of an alternative embodiment.

FIG. 7 is a cross section through part of a conical coil spring **70*a* which could be used as an alternative to the spring 70 shown in FIGS. 3 to 5. As discussed, a circular cross section is optimal for reducing creep. However, if the spring is to be moulded in line to have its conical shape in the as-moulded condition, it is preferable to have undercuts in the region of the break line of the mould. Accordingly the section of the spring 70*a* is generally square and has diagonally opposed corners 71, 72 along the break line 75 of the mould. However, the opposite diagonally opposed corners 73, 74** are rounded, tending more towards a circle. The result is a section which is practical to mould and creeps less than an absolute square section.

Although a preferred embodiment of the invention has been specifically illustrated and described herein, it is to be understood that minor variations may be made in the apparatus without departing from the spirit and scope of the invention, as defined by the appended claims.

What is claimed is:

1. A closure for a bottle comprising:

a body having a feed cylinder with an open feed end and a wall located radially outwardly of the feed cylinder;

a sealing cap in communication with the open feed end of the body and movable between an open position and a sealed position;

a biasing member having opposed ends, one end of the biasing member being attached to the sealing cap and the other end of the biasing member being secured to the wall of the body to move the sealing cap between the sealed position, wherein the sealing cap seals the open feed end of the feed cylinder, and the open position, wherein the open feed end of the feed cylinder is unobstructed to allow water to flow through the open end of the feed cylinder when the bottle is placed on a water fountain spike and to reseal the feed cylinder when the bottle is removed, wherein the sealing cap is biased towards the sealing position by the biasing member.

2. A closure as claimed in claim 1, wherein the biasing member comprises a spring.

3. A closure as claimed in claim 2, wherein the spring is a coil spring.

4. A closure as claimed in claim 2, wherein the spring is formed from a plastic material.

5. A closure as claimed in claim 4, wherein the plastics material has a substantially square cross-section.

6. A closure as claimed in claim 2, wherein the spring has a generally conical shape.

7. A closure as claimed in claim 1, wherein the sealing cap is a stopper element that plugs the open feed end of the feed cylinder.

8. A closure as claimed in claim 1, wherein the sealing cap and the feed cylinder are constructed and arranged such that the distance the sealing cap is moved with respect to the feed cylinder by the water fountain spike is greater than the distance the sealing cap must be returned by the biasing member to reseal the feed cylinder.

9. A closure as claimed in claim 1, wherein the biasing member is in a substantially unstressed state when the sealing cap is in its sealed position.

10. A closure as claimed in claim 1, wherein the biasing member is pre-stressed when the sealing cap is in its sealed position.

11. A closure as claimed in claim 1, wherein the closure is constructed and arranged such that a lower end of the sealing cap is pushed through and out of the feed cylinder approximately 25 mm against the action of the biasing member as the water bottle is placed on the water fountain spike, and in this open position the lower end of the sealing cap is held approximately 15 mm away from the open feed end of the feed cylinder, such that a return of approximately 15 mm or more provided by the biasing member is sufficient to reseal the feed cylinder.

12. A closure as claimed in claim 1, wherein the closure includes a securing device for permanently securing the closure to the bottle.

13. A closure as claimed in claim 12, wherein the securing device comprises a hinged annulus constructed and arranged to be upturned to engage a corresponding bead on a bottle neck.

14. A closure as claimed in claim 1, further comprising a bridging portion secured to the wall.

15. A closure as claim in claim 14, wherein the other end of the biasing member is attached to the bridging portion.

* * * * *